US006759933B2

(12) United States Patent
Fallak

(10) Patent No.: US 6,759,933 B2
(45) Date of Patent: Jul. 6, 2004

(54) POSITION SELECTOR DEVICE

(75) Inventor: Klaus Fallak, Werne (DE)

(73) Assignee: AB Eletronik GmbH, Werne (DE)

( * ) Notice: Subject to any disclaimer, the term of this patent is extended or adjusted under 35 U.S.C. 154(b) by 0 days.

(21) Appl. No.: 09/899,805

(22) Filed: Jun. 29, 2001

(65) Prior Publication Data

US 2002/0056321 A1 May 16, 2002

(30) Foreign Application Priority Data

Jun. 30, 2000 (DE) ..... 100 31 096
Jun. 30, 2000 (DE) ..... 200 11 175 U

(51) Int. Cl.[7] ..... H01H 9/00
(52) U.S. Cl. ..... 335/207; 200/404
(58) Field of Search ..... 335/205–207; 200/404

(56) References Cited

U.S. PATENT DOCUMENTS

| | | | | |
|---|---|---|---|---|
| 5,134,898 A | | 8/1992 | Anderson | |
| 5,698,909 A | * | 12/1997 | Miyazawa | 335/207 |
| 6,069,552 A | | 5/2000 | Van Zeeland | |
| 6,380,733 B1 | | 4/2002 | Apel et al. | |

FOREIGN PATENT DOCUMENTS

| | | |
|---|---|---|
| DE | WO 9826341 | 6/1998 |
| EP | 0 587 406 A2 | 3/1994 |
| EP | 1 167 109 A3 | 1/2002 |
| GB | 2199926 | 7/1988 |
| JP | 11-224570 | 8/1999 |
| WO | WO 93/18475 | 9/1993 |

* cited by examiner

*Primary Examiner*—Lincoln Donovan
(74) *Attorney, Agent, or Firm*—Milde & Hoffberg, LLP

(57) ABSTRACT

A position selector device having:

(a) an inverted cup-like base body with an upper portion and a side portion;

(b) a substantially cylindrical rotary member mounted on a shaft, and arranged to rotate within the base body;

(c) a first position sensor for sensing the angular position of the rotary member;

(d) a toothed ring arranged to provide raster movement of the rotary member;

(e) a disk disposed centrally within the upper portion of the base body and arranged for tilting and/or lateral displacement within the base body;

(f) a second position sensor for sensing the tilting and/or lateral displacement; and (g) a magnet arrangement for restoring said disk to its central position in said base body after its tilting and/or lateral displacement movement.

29 Claims, 10 Drawing Sheets

POSITION SELECTOR DEVICE

BACKGROUND OF THE INVENTION

The invention relates to an position selector device to create electronic signals representing selector positions.

A selector device to create selector positions is known from International Patent Publication No. WO 98 26 341 A1, and its corresponding U.S. Pat. No. 6,380,733. So that the selector positions may be created easily whose final positions may be securely used largely free of mechanical wear, a rotary sensor is provided that is free to move about its longitudinal axis and thus to position its position sensor teeth opposite teeth of a first position selector unit and to determine these positions by means of first position sensor elements that are positioned along the longitudinal axis in a finger body that may be pushed into a recess. For this, a second rotating body is placed upon a second position selector unit, and its position is determined via a second position sensor element. The second position selector unit is positioned opposite a base body via a two-dimensional positioning device. These positions are determined by third position sensor elements.

This mechanism has proved itself, but has room for improvement. The main point is that pre-selected positions that are arrived at via two-dimensional displacement may be simplified.

SUMMARY OF THE INVENTION

This objective, as well as further objects which will become apparent from the discussion that follows, are achieved, in accordance with the present invention by providing a position selector device having:

(a) an inverted cup-like base body with an upper portion and a side portion;

(b) a substantially cylindrical rotary member mounted on a shaft, and arranged to rotate within the base body;

(c) a first position sensor for sensing the angular position of the rotary member;

(d) a toothed ring arranged to provide raster movement of the rotary member;

(e) a disk disposed centrally within the upper portion of the base body and arranged for tilting and/or lateral displacement within the base body;

(f) a second position sensor for sensing the tilting and/or lateral displacement; and (g) a magnet arrangement for restoring said disk to its central position in said base body after its tilting and/or lateral displacement movement.

The advantages achieved by the invention consist particularly of the fact that the disk body is located in the engaging area of the user's fingers, thus allowing easy operation.

Based on this, a magnetic tilt switch or slide switch may be produced that may be used to adjust a mirror or similar device in a motor vehicle. If necessary, this switch may be implemented with or without position assignment. The tilt switch device may also be a part of a tilt and raster switch device, or part of a tilt, raster, and tip switch device. The selector positions of the rotor hollow body are thereby accepted without making a sound. In order to provide the sounds that the user has come to expect, switching sound spheres are incorporated into switching sound grooves of a switching sound ring magnet. By the use of a repelling magnet element, the tilt magnet element allows switching movements that may be influenced by magnetic characteristic force curves. The tilt, push, raster, and/or tip positions are determined by the position arrangement, and the signals generated by the device may be used for regulators, controllers, switching, displays or similar apparatus.

The base body may be part of the rotor hollow body or of a separate switch. It may be shaped corresponding to the circumstances of its use.

The disk body may be either tilted or displaced above the motion element opposite the rotor hollow body.

The tilting may be supported by an at least partially surrounding groove. The groove may be of various cross-sectional shapes such as round, oval, or triangular. At least one sphere may be provided to support the displacement motion. The housing body may be at least partially surrounded by a hollow cylinder. This cylinder rests at least partially on a dimming element. Thus, the entire raster tilting switch is supported and the housing dimming body is guided securely.

The housing body may include a tilt switch receiver recess. The disk body may fit into this tilt switch receiver recess. The disk body may be held by a link with the base position arrangement opposite the rotor hollow body. This base position arrangement ensures that the disk element always returns to a defined initial position after it leaves the operating position. Thus, simple and reliable operation of the disk body is provided.

If the disk body is displaced, a displacement body recess may be provided that can work together with a displacement wall of the tilt switch recess.

A label plate may be incorporated into the disk body. The raster tilt switch may be designated using this label plate, making it easier to locate.

The basic position magnet arrangement may consist of an upper magnet incorporated into the disk body opposite which a plate element may be positioned that may be located within a final plate element of the rotor hollow body. This ensures that the disk body returns to its initial position. The lower plate element may be formed of an iron plate element or as a lower magnet.

The position sensor element may consist of a light sensor. It may consist of an arrangement of magnets that may be moved opposite a Hall sensor. Depending on the identification of individual positions, the arrangement of magnets may be formed of at least one displacement magnet element, or a ring magnet with corresponding polarization. Displacement switches, tilt switches, and/or rotation switches may all use Hall sensors. Double switches that are assigned to the magnet elements might find additional use as position sensors. Double Hall sensors may also be used as rotation sensors. This makes it possible to determine the direction of rotation.

Two opposing noise sphere receptor recesses may be included in the stator body element into each of which a switching sound sphere is inserted. Of course, other switching sound spheres may be included for which the corresponding recesses are provided. In order to emphasize individual switching positions, two or more switching sound spheres may be positioned adjacent to each other. Also, the switching sound spheres may be of differing sizes, and may be implemented as complete or hollow spheres.

Likewise, numerous switching sound grooves may be positioned in the switching sound ring magnet element as there are position sensor teeth. The individual elements may be compatible with one another.

The tilt switch device may also be expanded so that the magnet counter-element is a repelling magnet element that is positioned opposite the tilt magnet element on one side, whereby at least the plate element is arranged opposite the tilt magnet element on its other side. For this, the tilt magnet element may be arranged with one of its magnetic poles opposite the same magnetic pole of the counter-magnet element, and with its other magnetic pole at least opposite the disk element. Thus, the tilt motion curve may be effectively influenced. The curve may be additionally influenced if the tilt magnet element and/or the counter-magnet element include halves of a magnetic north pole and a magnetic south pole. In addition to the magnetic division, at least an iron yoke may at least partially surround the tilt switch magnet element.

A damping body may be positioned at least partially between the plate element and the tilt magnet element. This damping body damps the strike of the tilt magnet element against the plate body. Additionally, it influences the beginning of the tilt motion by means of its spring force.

The plate element may be in the form of a steel plate element. This makes the magnetic attractive force issuing from the magnet element effective.

The individual parts of the position selector device, such as the tilt magnet element, counter-magnet element, steel plate element, damping supports, etc. may be arranged within a tilt switch housing body. This tilt switch housing body may be pressed into a tilt switch receiver recess of the stator body elements. Simultaneously, the shaft element may be continued as a pushrod element that transfers the tilt motions issuing from the shaft element to the tilt magnet element. The tilt switch device may be produced at another location, and needs only to be finally inserted into the stator body element. This would greatly reduce manufacturing costs. If defects appear in the tilt switch device, it may be extracted and repaired or replaced by a new unit.

All magnet elements used may be in the form of permanent magnets.

For a full understanding of the present invention, reference should now be made to the following detailed description of the preferred embodiments of the invention as illustrated in the accompanying drawings.

DESCRIPTION OF THE PREFERRED EMBODIMENT

Figure 1A:
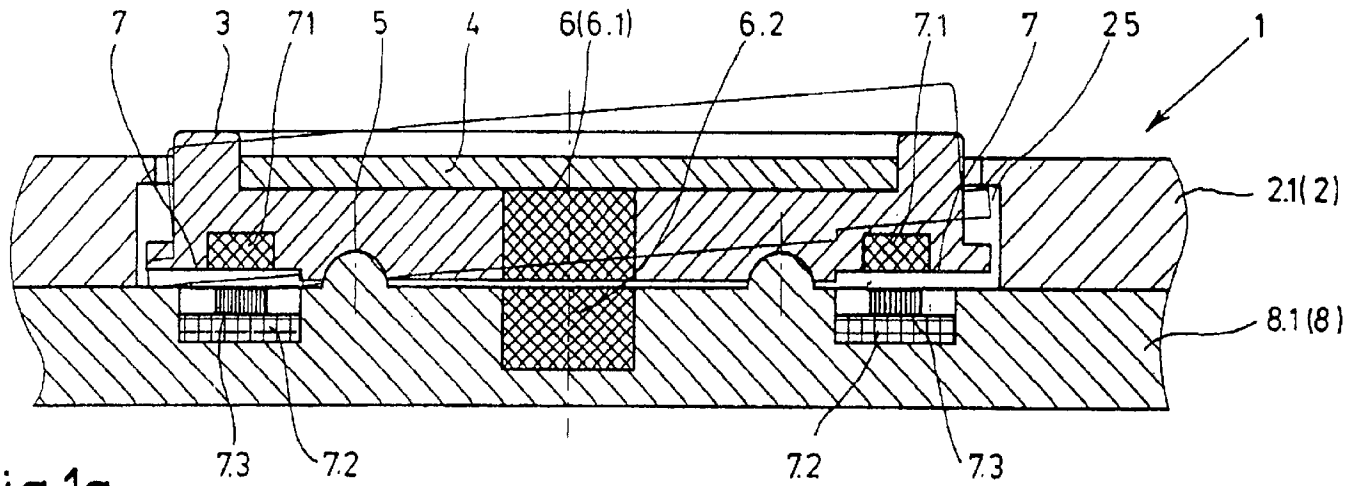
FIG. 1*a* shows a tilt switch device in a schematic cutaway view.

The preferred embodiments of the present invention will now be described with reference to FIGS. 1–16 of the drawings. Identical elements in the various figures are designated with the same reference numerals.

FIG. 1*a* shows a tilt switch device.

The tilt switch device 1 includes a disk body 3 that is inserted into a tilt switch receiver recess 25 of a housing plate element 2.1 of a housing body 2 and that is held with the help of a basic position magnet arrangement 6 opposite a rotor hollow body 8. The disk body 3 includes a label plate 4 that is surrounded by a ring groove. An at least partially surrounding recess for at least a partially surrounding motion element 5 is positioned on the opposite side of the disk body on a final plate element 8.1. The motion element functioning as a tilt element may have a triangular, round, or oval shape. When the disk body 3 is actuated from one side, it is linked with a projection on the one side and a cavity on the opposite side. The motion element 5 may also be implemented using inserted spheres that represent a very easily-moveable sphere link connection for each position.

The basic position magnet arrangement 6 consists of an upper magnet 6.1 that is inserted into the disk body 3. A lower magnet 6.2 is inserted into the final plate element 8.1. Both magnets ensure that the disk body 3 always returns to a defined initial position.

A position sensor 7 is provided to determine the tilt positions here between the disk body and the final plate element. At least one permanent magnet 7.1 is located on the underside of the disk body 3. This magnet may consist of a large number of individual magnets or of a ring magnet with north and south poles. A sensor plate 7.2, implemented as a circuit board, is inserted into the element 8.1 on which the sensor elements 7.3 are mounted. Simple or double Hall sensors may be used as a sensor element 7.3.

Figure 1B:
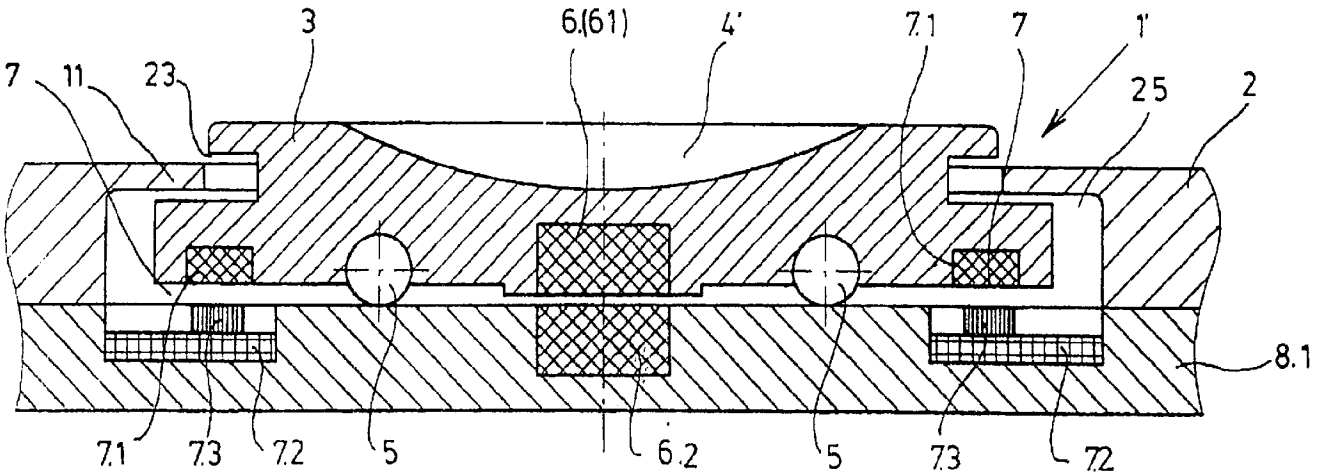
FIG. 1*b* shows a displacement switch device in a schematic cutaway view.

FIG. 1*b* shows a displacement switch device 1'. It has the same design as the tilt switch device as in FIG. 1*a*. So that the disk body 3 may be displaced laterally, a motion element 5 may be realized using spheres that are in corresponding recesses. Also, the disk body 3 includes an at least partially surrounding disk body recess 23 into which an at least partially surrounding displacement wall 11 engages, depending on displacement movement. The previously described position sensor 7 is used to determine the displacement positions. The described tilt- or displacement switch device may be used individually for the adjustment of mirrors or similar devices within a motor vehicle. Since it functions according to magnetic principles, practically no wear occurs. In the embodiment shown, the tilt switch device 1 is part of the overall switching device.

Figure 2:
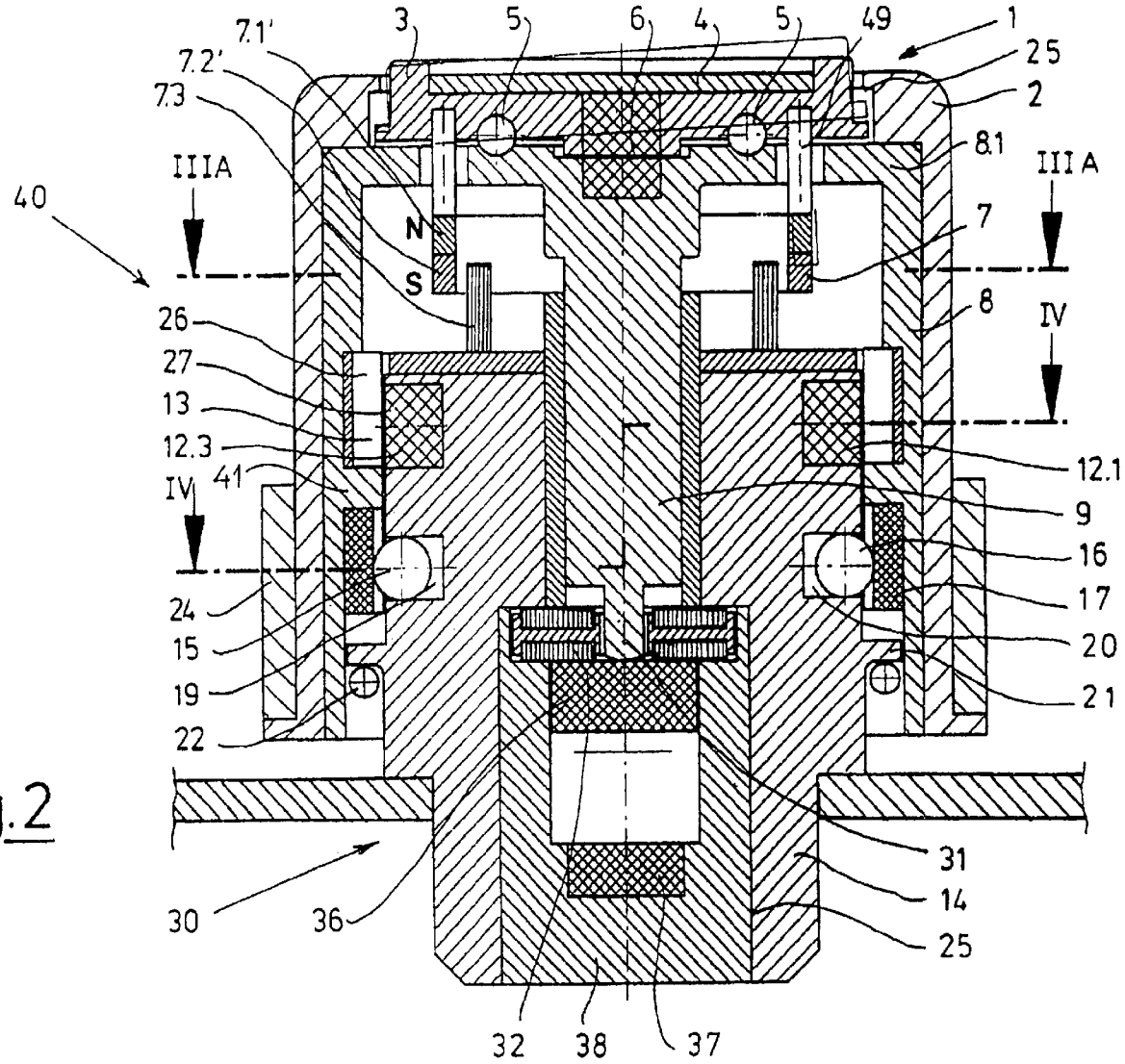
FIG. 2 shows a tilt, raster and/or tip switch device in a schematic cutaway view.

The tilt, raster, and tip switch device shown in FIG. 2 is composed of three switching devices:

tilt switch device 1 as in FIG. 1*a,* a raster switch device 40 and a tip switch device 30.

The raster switch device 40 consists of a stator body element 14 and the rotor hollow body 8.

In the stator body element are four opposing magnet elements 12.1, 12.2, 12.3, 12.4. Below them are two opposing sound sphere receptor recesses 19, 20, into each of which a switching-sound sphere 15, 16 is inserted. The stator body element is enclosed by a surrounding arresting edge body 21, under which securing pin bodies 22 are positioned. A shaft guide bushing element 14 is inserted into the stator body element 40. Below this is located a tilt switch receiver recess 25.

Figure 3A:
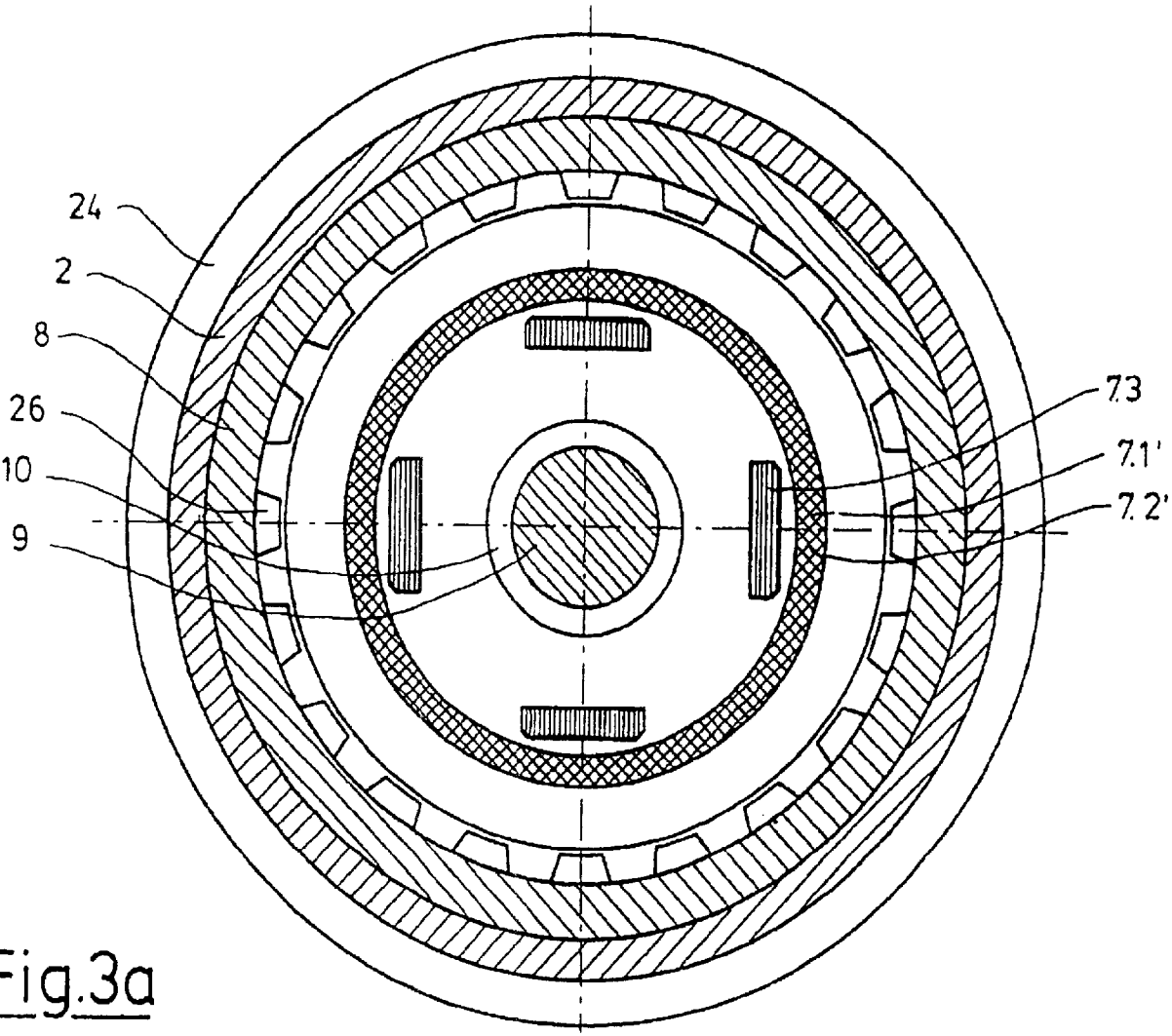
FIG. 3*a* shows a cross-section through a device as in FIG. 2 along line III A—III A.

The rotor hollow body 8 has an essentially blade-covering configuration from whose center a shaft element 9 projects. A position sensor toothed ring element 13 is located within the interior of the rotor hollow body, as FIG. 3*a* shows, that includes a large number of position sensor teeth 26 between which position sensor tooth recesses are located. The size of the position sensor tooth recesses may include different lengths.

Below the position sensor toothed ring elements 13 (see also FIG. 4) is located a switching-sound ring magnet element 17 with switching-sound grooves 18.1, . . . 18.*n*. The number of switching-sound grooves may be varied correspondingly. It is generally compatible with the number of position sensor teeth 26.

When the rotor hollow body 8 is placed on the correspondingly-configured stator body element 14, the magnet elements 12.1, . . . , 12.4 are opposing the position sensor toothed ring element 13 with the position sensor teeth 26, and the surrounding switching-sound ring magnet element 17 with switching-sound grooves 18.1, . . . is also opposing the switching sphere receptor recesses 19, 20 with the switching spheres 15, 16.

The housing body 2 is pressed onto the rotor hollow body 8. The housing body 2 is at least partially surrounded by a securing hollow body cylinder 24 which may be attached to a dimming element.

Figure 3C:
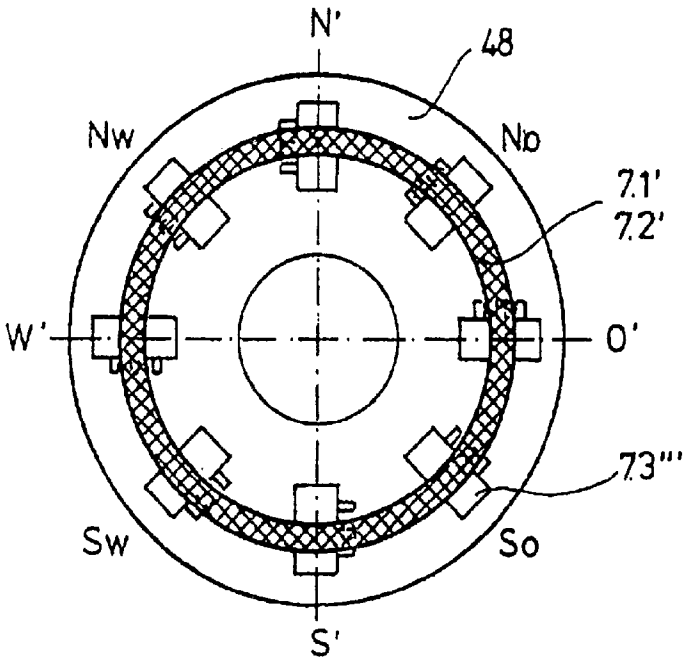
FIGS. 3*b* and 3*c* show additional embodiments of a position selector arrangement as in FIG. 3*a*.
Figure 3B:
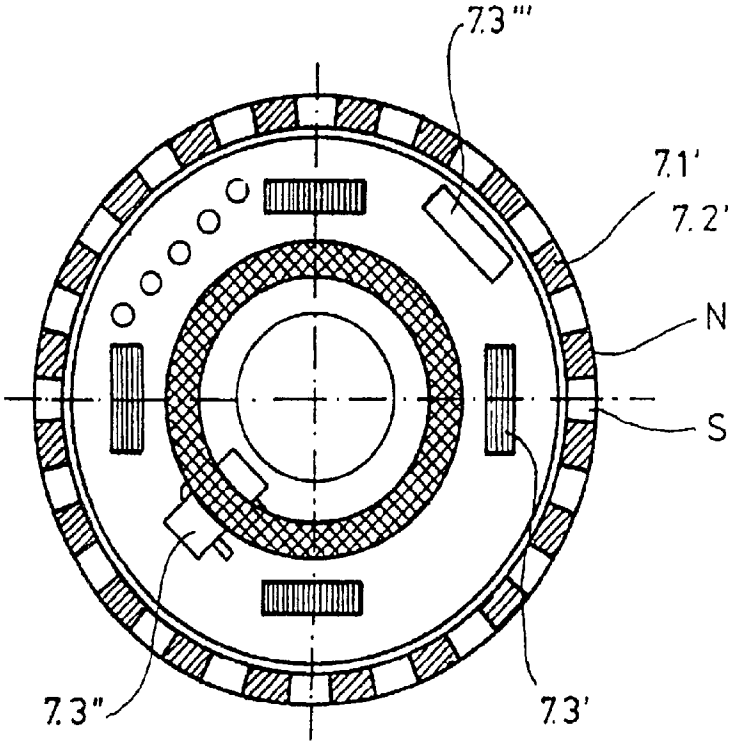

A position sensor designated with 7 is also positioned between the rotor hollow body 8 and the stator body element 14. This replaces the one described in FIG. 1*a*, but may also be augmented by it. A ring magnet 7.1', 7.2' with north and south poles N, S is attached to it. The position sensors 7.3 are positioned on the element 14 (see also FIG. 3*a*). As FIG. 3*b* shows, the position sensors may be replaced by displacement sensors 7.3' that also indicate the tilt positions as a tip sensor 7.3" and/or as a rotation sensor 7.3'". As FIG. 3*c* shows, the sensors 7.3'" are realized as double Hall sensors, and are positioned separately but adjacent to one another in a disk-shaped circuit board 48. This allows, among other things, the detection of rotation direction, particularly of the rotor hollow body 8.

Figure 4:
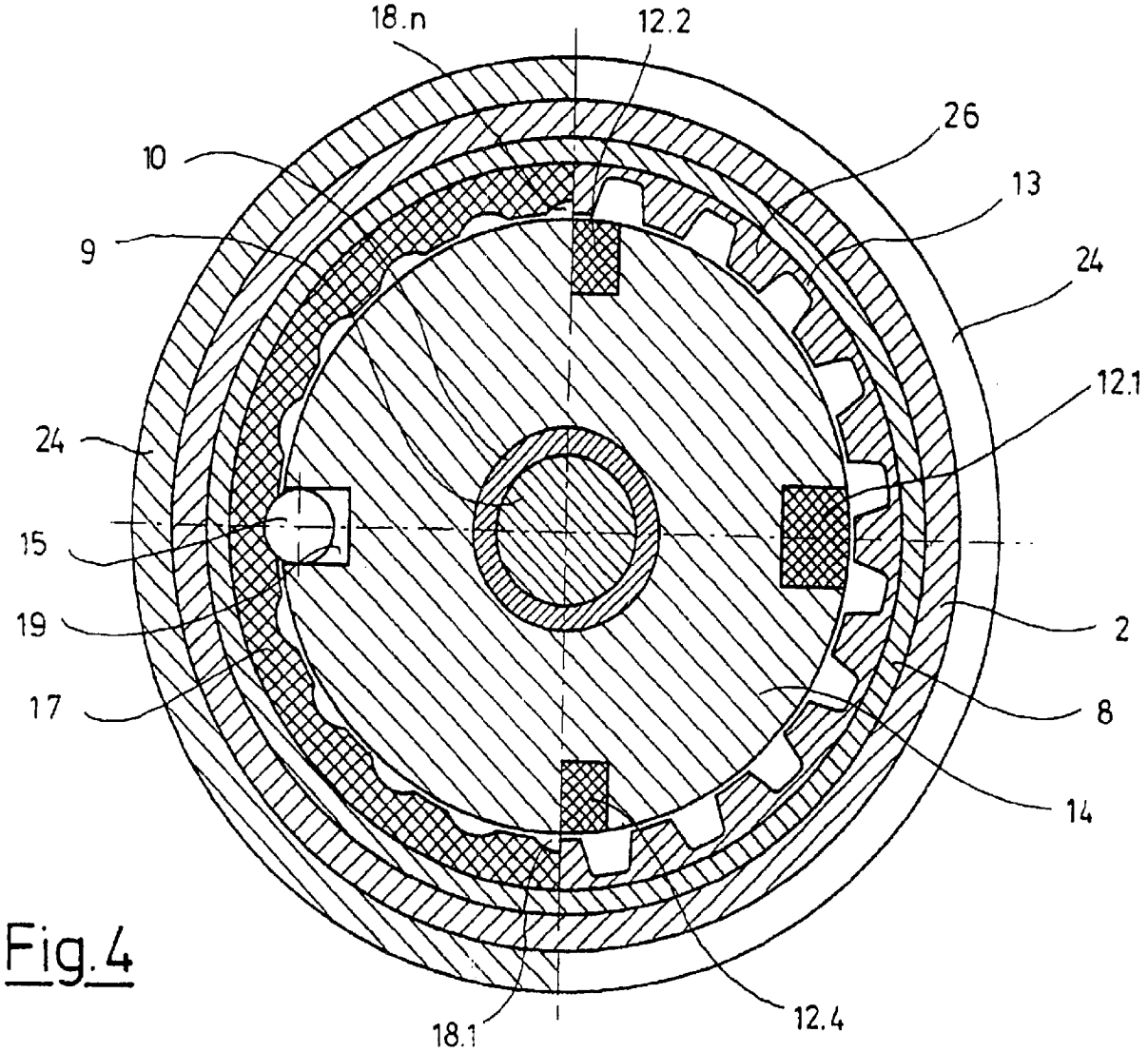
FIG. 4 shows a cross-section through a device as in FIG. 2 along line IV—IV.

FIG. 4 shows the previously-described position of magnet elements 12.1, . . . with respect to the position sensor teeth 26 of the position sensor toothed ring elements 13, and the noise sphere receptor recesses 19 with the switching-sound spheres 15 with respect to the grooves 18.1, . . . of the switching-sound ring magnet element 17.

Figure 7A:
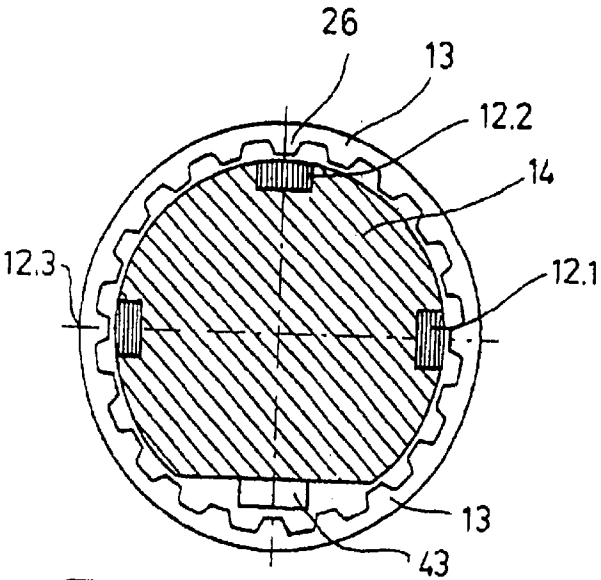
FIGS. 5*a* through 7*a* show various embodiments of raster position configurations as in FIG. 4 with corresponding double Hall sensors as further position sensors with pertinent characteristic curves as in FIGS. 5*b* through 7*b*.

In FIG. 7*a*, a double Hall sensor 43 is assigned to at least one magnet element 12.1, etc. Thus, positions may also be determined so that this arrangement may be used either as a primary position sensor 7 or as an additional position sensor.

Figure 5A:
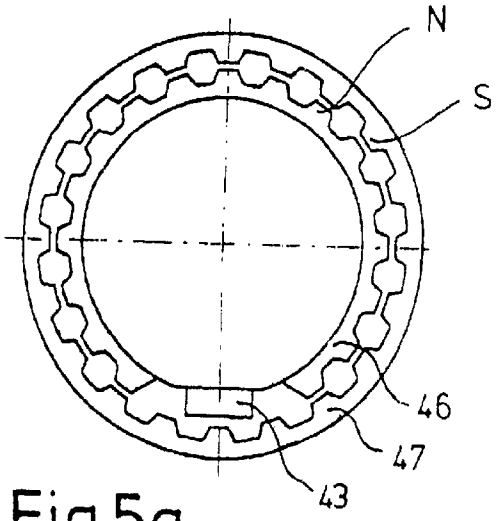

FIG. 5*a* shows an alternative embodiment with a Hall sensor 43, as in FIG. 7*a*, in which a stator and a rotor ring magnet 44, 47 with north and south poles N, S oppose each other.

Figure 6A:
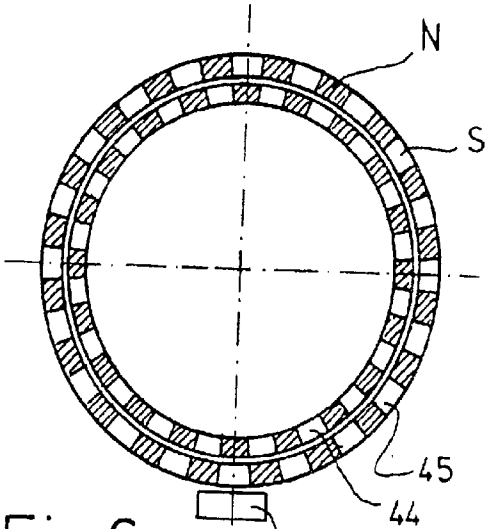

FIG. 6*a*) shows another alternative embodiment, in which a stator and rotor ring magnet 44, 45 oppose each other. Both magnets have alternating north and south poles N, S.

Figure 7B:
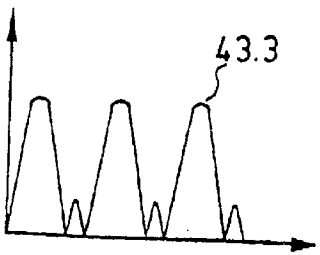
Figure 6B:
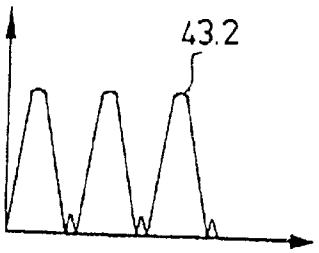
Figure 5B:
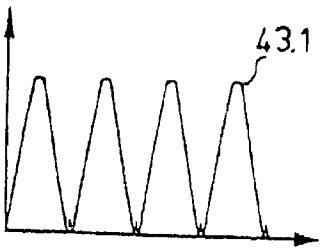

FIGS. 5*b*, 6*b* and 7*b* show pertinent switching curves. A switching curve 43.1 of the double Hall switches 43 (FIG. 5*b*) belongs to a configuration per FIG. 5*a*, a switching curve 43.2 (FIG. 6*b*) to a configuration per FIG. 6*a* and a switching curve 43.3 (FIG. 7*b*) to a configuration per FIG. 7*a*. It is clear that the switching curve 43.3 shown in FIG. 7*b*) best reproduces the individual positions.

The tip switch device 30 is shown in detail in FIG. 2 and in FIGS. 8 through 14. It consists of a tilt switch housing body 38. A counter-magnet element 37 is in the floor of the tip switch housing hollow body.

Figure 9:
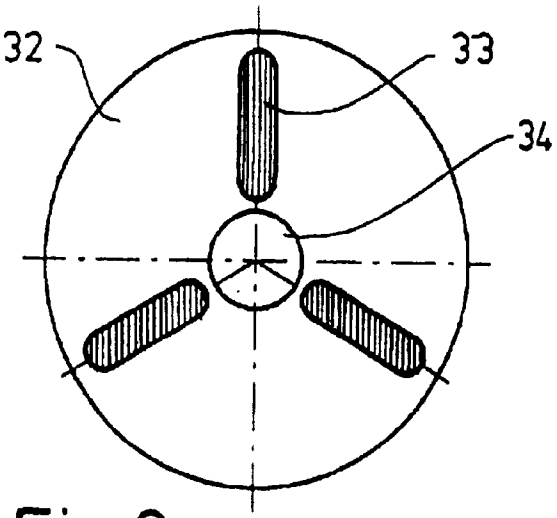
FIG. 9 shows a steel plate element for a tilt switch device as in FIG. 8.
Figure 10:
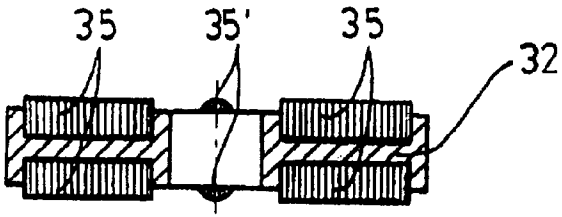
FIG. 10 shows a steel plate element as in FIG. 9 with employed damping bodies.
Figure 8:
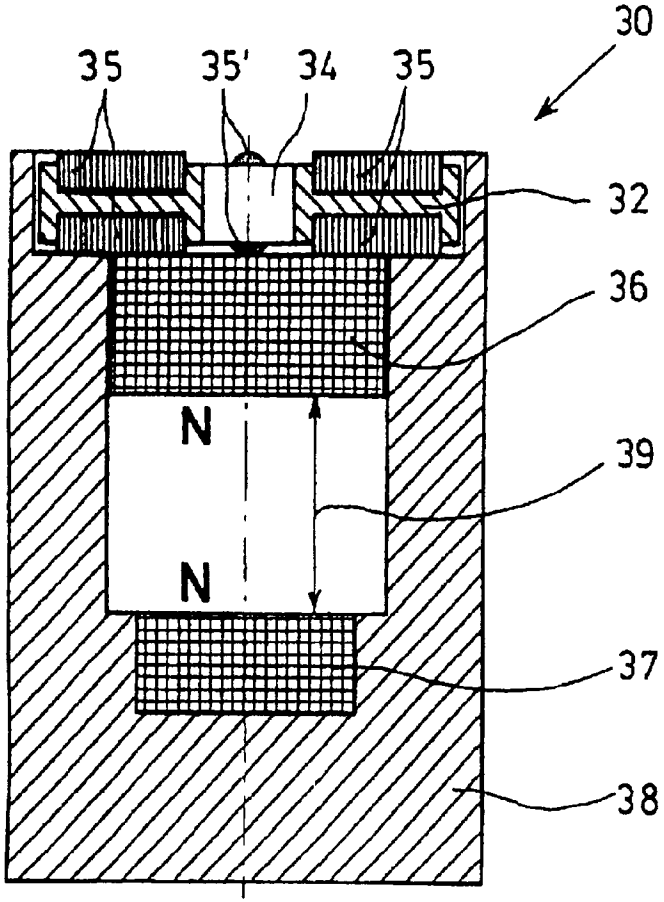
FIG. 8 shows a tilt switch device for a tilt, raster and/or tip switch device as in FIG. 2.

The opposing open side of the tip switch housing hollow body 38 is closed with a steel plate element 32 that is shown in detail in FIGS. 9 and 10. It has an essentially circular configuration. Three recesses 33 in the form of elongated holes are made in the steel plate element 32. As FIG. 10 shows, the steel plate element 32 is equipped on both sides with damping bodies 35 and 35' made of rubber or resilient plastic. In the center of the steel plate element 32 is a pushrod recess 34. As FIG. 8 particularly shows, a moveable tilt magnet element 36 with its north pole N is opposite the north pole of the counter-magnet element 37, creating a repelling magnetic effect.

Figure 11A:
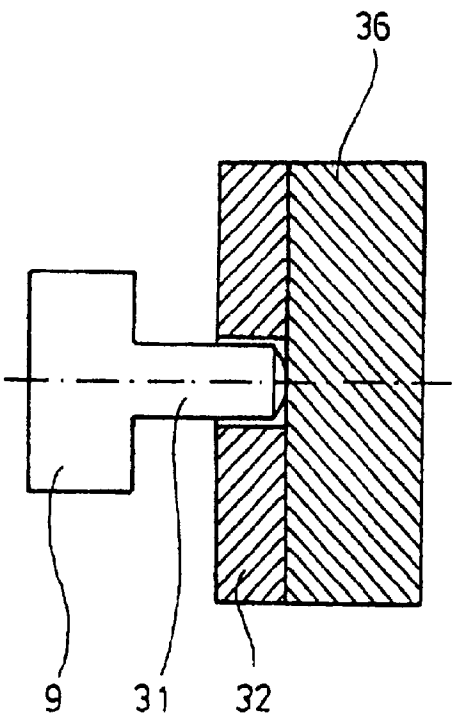
FIGS. 11*a* and 11*b* show a partial tilt configuration for a device as in FIGS. 2 and 8.

FIGS. 11*a* and *b* show a section of the steel plate element 32, the magnet 36, and the shaft element 9 with pushrod element 31. The steel plate element 32 may also be in the form of a magnet.

Figure 13:
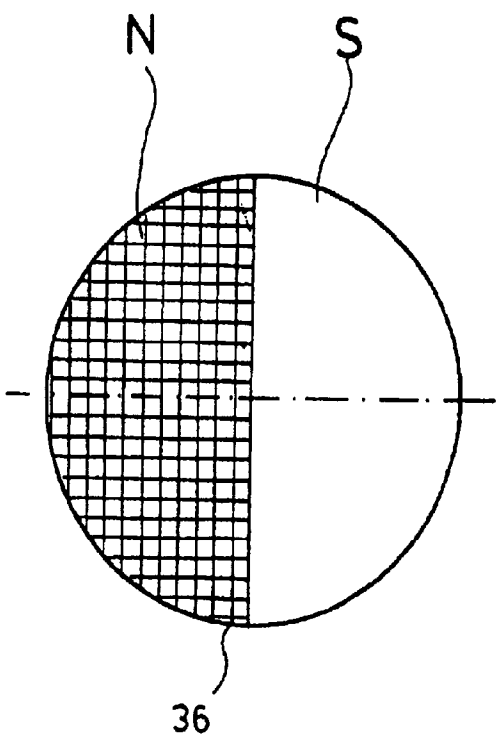
FIGS. 12 and 13 show embodiments of magnets for a tilt switch device.
Figure 12:
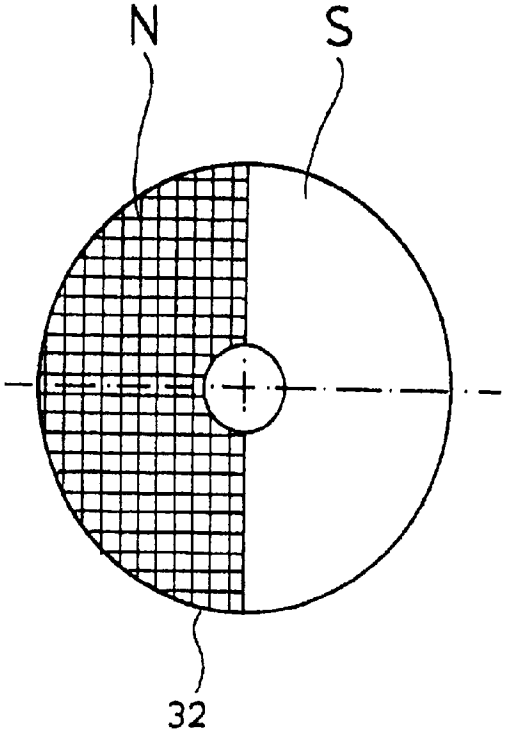
Figure 11B:
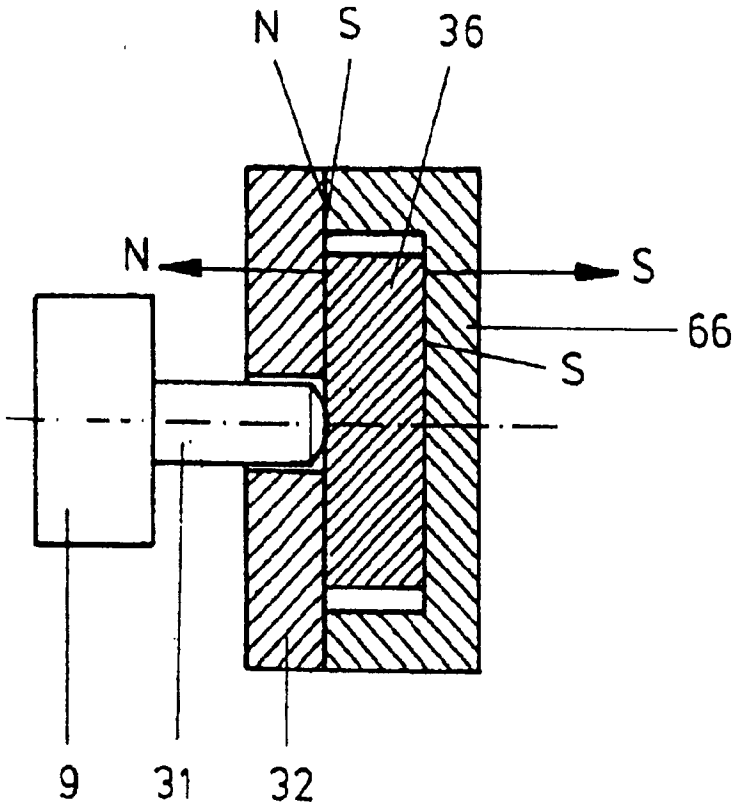

As FIGS. 12 and 13 show, half of the magnets 32 and 36 have a north pole N, and half have a south pole S. this increases the magnetic repelling force 39. This may be increased even further if, as FIG. 11*b* shows, the magnet 36 is surrounded by a U-shaped iron yoke 66. The north pole N of the magnet 36 rests on the pushrod element 31 and opposite the magnetic south pole S. This produces a situation in which the steel plate element has a north pole N and the U-shank of the iron yoke has a south pole S, and a magnetic short-circuit with a high force of attraction is present.

The particular advantage is that the tip switch device 30 so constructed may be produced and assembled separately at another location, and need only be inserted into the tip switch receptor recess 25 of the stator body element 14 during installation. This is formed near the recess in steps, and can thus be inserted into a recess of a securing plate 42.

To employ the tip switch device 30, the pushrod element 31 that is integrated with the shaft element 9 is inserted into the pushrod recess 34.

The principle of operation of the tilt, raster, and tip switch device as shown in FIGS. 1*a* and 2 through 4 is explained in the following paragraphs.

The housing body 2 is gripped with the user's fingers and rotated. The position sensor teeth thus assume a final position with respect to the magnet elements 11, 12 that may be in the form of permanent magnets. When the housing body is rotated, position movements occur as are known in mechanical raster mechanisms. Since the raster positions are based on a magnetic principle, they are without sound. In order to give the user the feel of a raster switch, switching-sound spheres are inserted into the switching-sound grooves 18.1 for each raster position, thus producing the expected switching sound. The sound quality of the switching-sound may be varied by the size of the switching-sound spheres and by their configuration as full or hollow spheres. Also, certain raster positions may be especially preferred. An intermediary body 41 (see FIG. 2) ensures that the rotating motion is completed cleanly.

With the help of the tilt switch device 1, a pre-selection from existing selection programs may be performed. If a "Program Station Selection Radio Station" is selected by pressing the disk body 3 down from one side, then the corresponding station selection is performed via the rotation of the housing body 2. So that the disk body 3 itself does not rotate, but rotates with the housing body 2, it is functionally connected with the rotor hollow body 8 lying underneath by means of connecting pins 49.

When the desired station is found by rotating the housing dimming body 8, an additional press on the disk body 3 of the rotor hollow body, and thereby via the shaft element 9, actuates the pushrod element 31.

Figure 15:
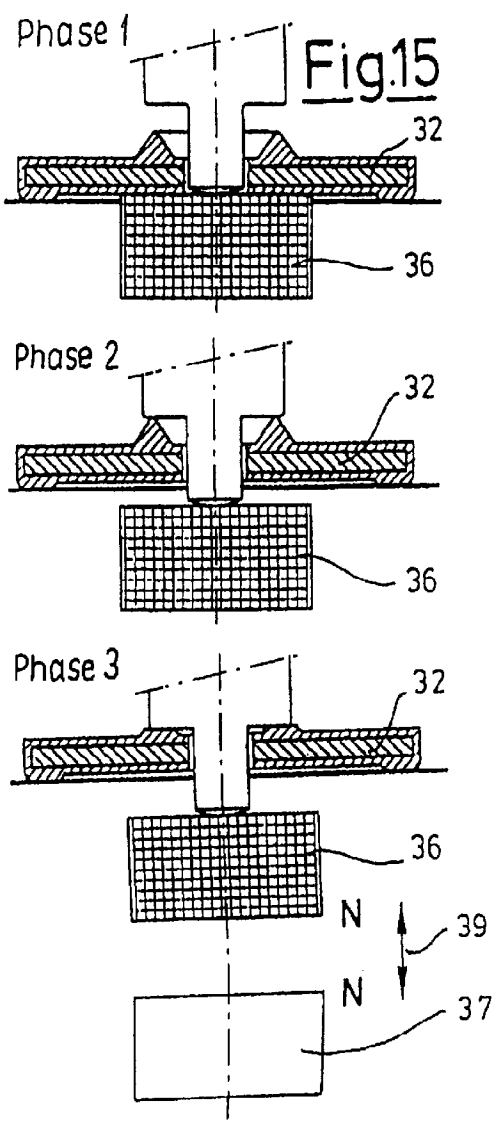
FIG. 15 shows individual phases of a movement of a configuration as in FIG. 14.
Figure 14:
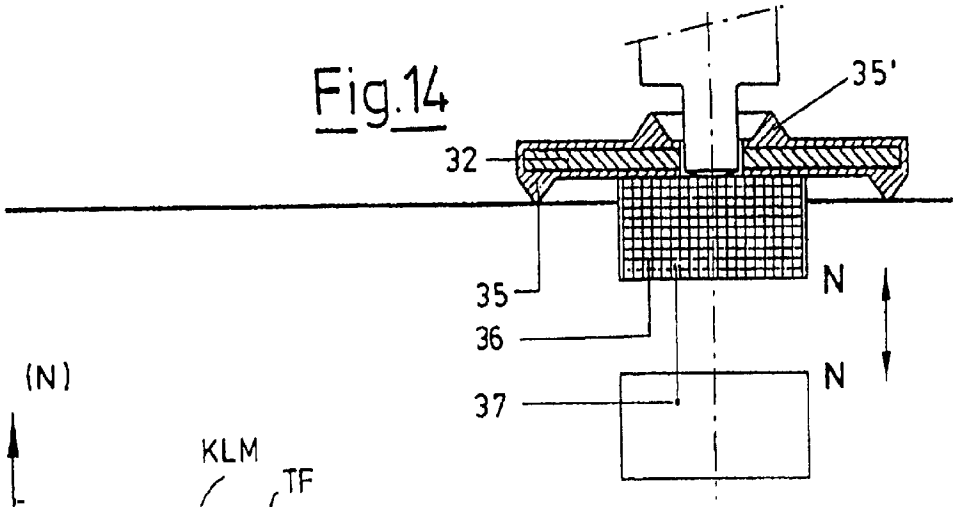
FIG. 14 shows a tilt configuration for a device as in FIGS. 2 and 8.

When the pushrod element 31 is actuated, it moves through the pushrod recess 34, as shown in FIGS. 14 and 15, toward the tilt magnet element 36. The magnetic repelling force 39 provides a counter-force to the downward tip motion. The tip motion ends when the shaft element 9 is resting on the upper damping body 35.

Figure 16:
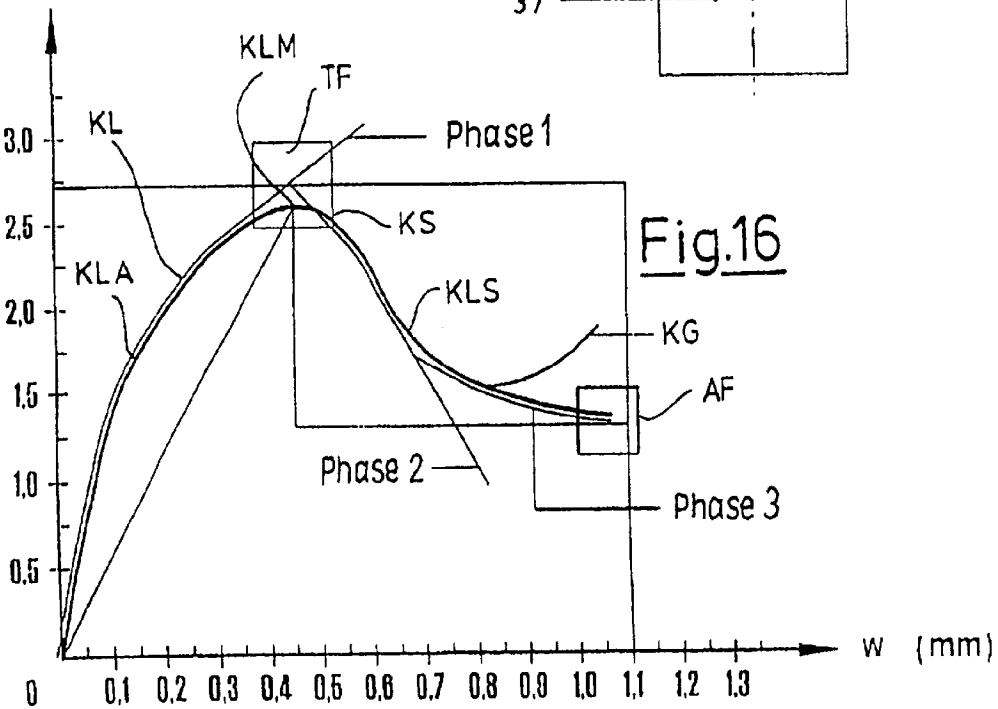
FIG. 16 shows a characteristic motion curve as a function of a force dependent on the path.

FIG. 16 shows a characteristic motion curve KL of a force K as a function of the path W that is created during phases 1 to 3 as shown in FIG. 15. In Phase 1, a curved curve increase KLA that may be similar to a sine wave occurs and leads to a curve maximum KLM. To this is appended a curved curve decrease KLS in Phase 2 that may be cotangent-shaped, and that attempts to swing upward in a curve as repelling magnet characteristic curve KG. The characteristic line KL ends in a strike window AF. A tolerance window TF is established at its maximum KLM that is a switching point KS, and that is assigned to one or more of the position sensors 7.3. The position sensor 7 as in FIG. 2 receives not only these, but also all tilt and rotation positions.

The positions are passed on as electronic signals.

The display in the vehicle shows that the tuned station has been acknowledged and is now available.

If the disk body 3 and thereby the rotor hollow body is relieved of the pressure motion, the counter-magnet element 37 presses the tilt magnet element 36 immediately further back into the initial position so that it rests on the damping bodies 35, 35'. The damping bodies damp not only the striking sound and the previous striking sound of the shaft element 9 when tipped, but also influence the curve progression of the characteristic motion curve KL and at the beginning of tipping in Phase 1. FIG. 15 shows clearly that, when the pushrod elements 31 are pressed onto the magnet 36, the stored spring force of the damping body 35, 35' supports the tip force against the magnetic repelling force 39. Additional influence on the characteristic motion curve KL is possible using mechanical springs.

When this selection is completed, another menu may be selected by another position of the disk body 3 whose program may be specially invoked. If the invoked program is a telephone book, telephone numbers are provided with the individual addresses that appear on the screen. The displayed addresses may also be linked to audio announcements with the name and telephone number. When the motor vehicle operator has found the correct number, this fact is acknowledged by means of the tip movement via the tilt switch device, and the party is called.

The particular advantage of the tilt, raster and tip switch device consists of the fact that the motor vehicle operator may invoke all types of programs using one hand, particularly allowing safe telephoning while driving. The position selector device may be integrated into the steering wheel so that the driver may keep both hands on the wheel while operating the raster, tilt switch. This increases automotive safety.

There has thus been shown and described a novel position selector device which fulfill all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A position selector device, comprising:

in combination:

(a) an inverted cup-like base body, having an upper portion and a side portion;

(b) a substantially cylindrical rotor hollow body mounted on a shaft, and arranged to rotate with the base body;

(c) a first position sensor for sensing the angular position of the rotor hollow body;

(d) a toothed ring arranged to provide raster movement of the rotor hollow body;

(e) a disk disposed centrally within the upper portion of the base body and arranged for at least one of tilting and lateral displacement within the base body;

(f) a second position sensor for sensing said at least one tilting and lateral displacement; and (g) a magnet arrangement for restoring said disk to its central position in said base body after movement thereof.

2. The position selector device recited in claim 1, further comprising:

(h) a stator body element which includes:

(1) at least one magnet element, (2) at least one noise sphere receptor recess with a switching sound sphere positioned therein, and (3) a shaft guide recess;

(i) wherein the base rotor hollow body includes:

(1) a position sensor toothed ring element having at least one position sensor tooth arranged opposite the magnet elements, (2) a switching sound ring magnet element with at least a switching sound groove, into which the switching sound spheres are inserted, and (3) a shaft element positioned in the shaft guide recess; and (j) a position sensor for determining the position of the rotor hollow body relative to the stator body element.

3. The position selector device recited in claim 1, further comprising:

(h) a moveable tip magnet element arranged on the shaft, with at least one repelling magnet element positioned opposite it, for producing a characteristic motion line (KL), and (i) position sensor means for determining the position of at least one of the moveable tip magnet element and the shaft, on one side, and the, repelling magnet with a switching point (KS) after a curve maximum (KLM), on the other side.

4. Device according to claim 1, wherein the disk may be tilted with respect to the base body.

5. Device according to claim 1, wherein the disk may be displaced laterally with respect to the base body.

6. Device according to claim 1, wherein the base body is at least partially surrounded by a holding hollow cylinder that at least partially rests on a stop ledge.

7. Device according to claim 1, wherein the base body includes a tilt switch receiver recess in which the disk is retained in the central position by means of the magnet arrangement.

8. Device according to claim 7, wherein the tilt switch recess is provided with an at least partially surrounding displacement wall.

9. Device according to claim 1, wherein the magnet arrangement comprises an upper magnet positioned in the disk body and a lower plate element positioned below the upper magnet.

10. Device according to claim 9, wherein the lower plate element comprises at least one of an iron plate element and a lower magnet.

11. Device according to claim 1, wherein the second position sensor comprises at least one of a light sensor and a magnet element which is moveable with respect to at least one Hall sensor.

12. Device according to claim 1, wherein the second position sensor comprises a magnet element which is attached to the disk and a Hall sensor arranged adjacent the magnet element.

13. Device according to claim 1, wherein the second position sensor comprises a ring magnet element with a north and a south pole (N, S) that is held by the disk and has an operative relationship with at least one Hall sensor.

14. Device according to claim 2, wherein a double Hall sensor is assigned to at least one of the magnet elements as a position sensor.

15. Device according to claim 14, wherein additional double Hall sensors are used as a rotation sensors.

16. Device according to claim 1, wherein a label plate is positioned in the disk.

17. Device according to claim 13, wherein the disk and the ring magnet element are connected via a linking pin.

18. Device according to claim 2, wherein two opposing noise sphere receptor recesses are positioned in the stator body element in each of which a switching-sound sphere is located.

19. Device according to claim 2, wherein there are as many switching-sound grooves in the switching-sound ring magnet element as there are position sensor teeth on the position sensor ring element.

20. Device according to claim 19, wherein the positions of the switching-sound grooves and the position sensor teeth are mutually compatible.

21. Device according to claim 3, wherein at least one plate element is positioned on the one side and a counter-magnet element as a repelling magnet element is positioned on the other side opposing the tip magnet element.

22. Device according to claim 21, wherein the tip magnet element is positioned with its one magnetic pole (N, S) opposite the same magnetic pole (N, S) of the counter-magnet element and with its other magnetic pole (N, S) at least opposite the plate element.

23. Device according to claim 3, wherein the tip magnet element includes as one half a magnetic north pole (N) and as the other half a magnetic south pole (S).

24. Device according to claim 21, wherein a damping body is at least partially positioned between the plate element and the tip magnet element.

25. Device according to claim 21, wherein the plate element is a steel plate element.

26. Device according to claim 24, wherein the tip magnet element, the counter-magnet element, the plate element and the damping body are positioned in a tip switch housing body.

27. Device according to claim 3, wherein the tip magnet element is displaced by a pushrod element that is integrated in the shaft.

28. Device according to claim 2, wherein the magnet element and the switching-sound ring magnet element are permanent magnets.

29. Device according to claim 3, wherein at least the tip magnet element is at least partially surrounded by an iron yoke.

* * * * *